United States Patent [19]

Bullat

[11] 4,047,554

[45] Sept. 13, 1977

[54] DRIVE MECHANISM AND APPLICATION TO A BLIND WITH VERTICAL SLATS

[75] Inventor: Jean Bullat, Bonneville, France

[73] Assignee: Carpano & Pons, France

[21] Appl. No.: 740,714

[22] Filed: Nov. 10, 1976

[30] Foreign Application Priority Data

Nov. 17, 1975 France ..... 75.35559

[51] Int. Cl.[2] ..... E06B 9/30

[52] U.S. Cl. ..... 160/168 R; 160/172; 160/176 B

[58] Field of Search ..... 160/168-178; 192/12 R, 33 R

[56] References Cited

U.S. PATENT DOCUMENTS 3,194,366 7/1965 Hensel ..... 160/173

*Primary Examiner*—Peter M. Caun

*Attorney, Agent, or Firm*—Robert E. Burns; Emmanuel J. Lobato; Bruce L. Adams

[57] ABSTRACT

A drive mechanism, for example of a blind with vertical slats, comprises first and second rotatable driving elements kinematically connected to a common rotary actuating element respectively by a first coupling arranged to immediately couple the first driving element for a limited rotation with the actuating element when the latter is rotated and a second coupling arranged to couple the second driving element for rotation with the actuating element after a given rotation of the latter. Each coupling comprises, on the first driving element and a facing fixed surface for the first coupling, and on the second driving element and the actuating element for the second coupling, a helix or spiral ramp and a facing transverse groove housing a ball which allows a limited relative rotation of the respective parts.

5 Claims, 8 Drawing Figures

DRIVE MECHANISM AND APPLICATION TO A BLIND WITH VERTICAL SLATS

The invention concerns drive mechanisms of the type comprising two rotatably mounted driving elements kinematically coupled to a common actuating element, the kinematic coupling of the first rotary driving element including a friction means, arranged so that the second rotatable driving element may act only when the first has carried out a given rotation.

In a known drive mechanism of this type, described in French Patent No. 1,539,457, the second driving element is an endless screw constantly kinematically coupled to the actuating element. A nut supported by the endless screw is prevented from turning and moves axially along the screw when the latter turns. This nut acts on the element it must drive, a support for a slat of a blind, only when it has moved a given distance along the endless screw. This known driving mechanism is thus relatively complex and bulky.

Moreover, the nut in question is disposed between the two first slat supports of a blind with orientable vertical slats of the type having several slat-supports movable in translation under the action of driving means, and a shaft the rotation of which in either direction correspondingly angularly sets at least a part of each support and a corresponding slat which is fixed to said part, this shaft being kinematically coupled by the intermediate of a friction coupling to the means for driving the slat-support in translation. After a given angular orientation of the slats under the action of said shaft, this nut acts on the second support or on the first support to respectively open or close the blind. It is observed that such a slat-blind is complex since it includes an endless screw in addition to the shaft. Moreover, when the blind is opened, the nut acts only on the second support, and the blind cannot be fully folded when it is in the open position, the first slat in effect remaining spaced apart from the other slats. Finally, both during opening and closing of the blind, the slats bear against one another and thus permanently rub against one another.

An aim of the invention is to provide a driving mechanism which may advantageously be incorporated in a slat-blind of the mentioned type and enables the mentioned drawbacks to be avoided.

According to the invention, a drive mechanism comprises first and second rotatable driving elements kinematically connected to a common rotary actuating element respectively by a first coupling arranged to immediately couple the first driving element for a limited rotation with the actuating element when the latter is rotated and a second coupling arranged to couple the second driving element for rotation with the actuating element after a given rotation of the latter, wherein each of said couplings comprises a ramp and a facing groove transverse to the ramp, each ramp and facing groove housing a mobile piece, the ramp and groove of the first coupling being provided on the first driving element and a facing fixed surface, and the ramp and groove of the second coupling element being provided on the second driving element and the actuating element.

In one embodiment, at least one of the ramps is formed by a hollow helix in a cylindrical surface, and the corresponding groove is disposed longitudinally of said cylindrical surface.

In another embodiment, at least one of the ramps is formed by a hollow spiral in a generally flat surface, and the corresponding groove is disposed generally radially of said spiral.

A compact mechanism can be provided by mounting the first driving element and the actuating element end-to-end on a shaft, on either side of a friction element, the first driving element being axially fixed and rotatable on the shaft and the actuating element being slidable along and keyed for rotation with the shaft, an elastic means constantly pushing the actuating element against the friction element and the first driving element.

In a blind with vertical orientable slats including a drive mechanism according to the invention, the first driving element of the mechanism may be constantly kinematically coupled to a shaft the rotation of which angularly sets the slats and the second driving element constantly kinematically connected to at least one longitudinally movable slat support.

The accompanying drawings show, by way of example, two embodiments of drive mechanism according to the present invention, and an application of such a mechanism in a blind. In the drawings.

Figure 1:
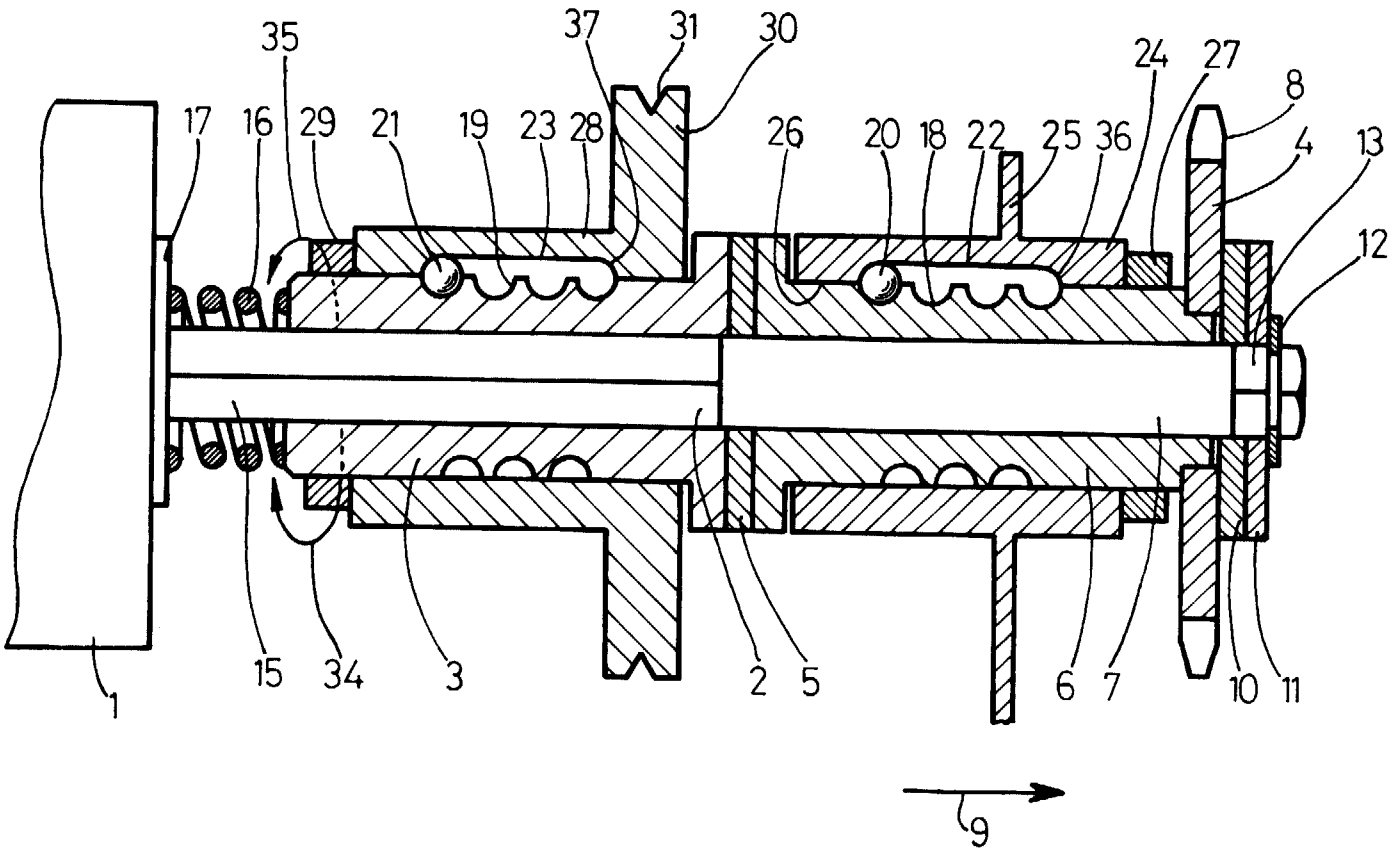
FIG. 1 is a cross-section of a first embodiment of drive mechanism according to the invention.

FIG. 1 shows a drive mechanism including a motor 1 which could alternatively be a manual actuating means, including a shaft 2 able to be rotated at will in either of the two direction of rotation. On this shaft 2 are disposed, end-to-end, an actuating element formed by a sleeve 3 and a first rotatable driving element 4 formed by a sleeve 6 and a toothed wheel 8 solid with the sleeve 6. A friction washer 5 is disposed between the facing ends of sleeves 3 and 6. Element 4 (i.e., sleeve 6) is rotatable on a cylindrical part 7 of shaft 2 and is prevented from moving axially in direction 9 on the shaft 2 by a second friction washer 10, a metal washer 11 and a stop ring 12. The washer 11 is prevented from turning by a square 13 of the shaft 12. Sleeve 3 is slidably mounted on a part 15 of shaft 2, for example of hexagonal profile which keys the sleeve 3 for rotation with shaft 2. A helicoidal compression spring 16 is disposed on the shaft 2 between a stop ring 17 of motor 1 and the end of sleeve 3 opposite to the friction washer 5. In their outer cylindrical surfaces, the sleeve 6 and sleeve 3 each have a respective hollow helix 18 and 19 each cooperating with a ball 20 and 21 respectively lodged partly in the helix and partly in a respective groove 22 and 23 disposed transverse to the corresponding helix. The groove 22 is disposed longitudinally in a fixed cylindrical element 24 solid with a support 25. This fixed element 24 serves as bearing for the outer cylindrical surface 26 of the sleeve 6 which may thus turn in element 24. The sleeve 6 is fixed axially with the fixed element 24 by a stop 27. The groove 23 is disposed longitudinally in a second cylindrical element 28 which is turnably mounted on the sleeve 3 and is axially fixed with the latter by a stop 29. Element 28 includes a pulley 30 provided with a groove 31 for driving a belt, not shown in the drawing, whereby it forms a second rotatable driving element.

Let us take as starting position, the position shown in FIG. 1. When the shaft 2 is rotated in direction 35 by the motor 1, the first driving element 4 (i.e., sleeve 6 and wheel 8) is immediately rotated in the same direction by the intermediate of the actuating element or sleeve 3 and friction washer 5. The toothed wheel 8 thus rotates an element, not shown in the drawing, that it serves to drive. At the same time, the helixes 18 and 19 are rotatably driven in direction 35 with their sleeves, and the corresponding balls 20 and 21 each move in direction 9 along their corresponding groove 22 or 23. During this time, the second driving element 28 remains angularly fixed, as it is held by the belt in groove 31. When the ball 20 arrives at the end 36 of groove 22, by the intermediate of the helix 18 it makes the sleeve 6 angularly solid with the fixed element 24. The first driving element 4 is thus stopped as well as the external elements it drives. When the sleeve 6 stops, the friction washers 5 and 10 come into action and allow the shaft 2 and the sleeve 3 to continue to turn. When the ball 21 arrives at the end 37 of groove 23, by the intermediare of the helix 19 it secures the sleeve 3 for rotation with the second driving element 28. The pulley 30 is thus driven rotatably in direction 35 together with the external elements to which it is connected. The relative lengths of the grooves 22 and 23 may be selected in such a manner that drive of the pulley 30 may commence at will before, at the moment of, or after stopping of the toothed wheel 8. The pulley 30 continues to turn as long as the shaft 2 is driven by motor 1 in direction 35. If the shaft 2 is then rotatably driven in the opposite direction 34, the same operation is repeated. The toothed wheel 8 is firstly driven in direction 34, then it stops when ball 20 arrives in the position of FIG. 1; when the ball 21 moves back to its position of FIG. 1, the pulley 30 is rotatably driven in direction 34.

As a variation, each helix and the corresponding groove may be provided in the opposite element; the helix 18 for example may be provided in the fixed element 24 and the groove 22 in the sleeve 6; operation of the assembly would be identical. Likewise, the sleeves 6 and the actuating element (sleeve 3) need not be disposed on the same shaft 2; they could for example be disposed each on a separate shaft, with friction means appropriately arranged between the two shafts or between one of the shafts and the motor. Likewise, the balls 20, 21, instead of abutting against the end of the corresponding grooves 22, 23, could abut against the end of the respective helix 18, 19.

Figure 2:
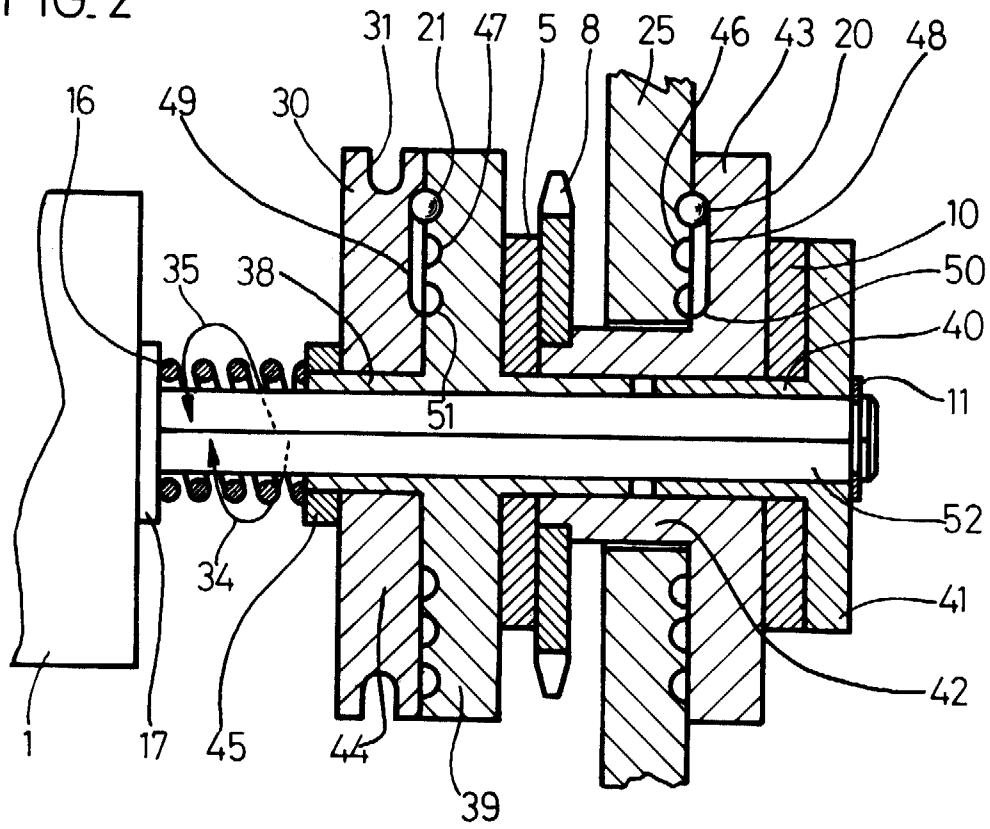
FIG. 2 is a cross-section of a second embodiment of the drive mechanism according to the invention.

In the second embodiment shown in FIG. 2, the helixes are replaced by spirals. This embodiment includes a hexagonal shaft 52 rotatably driven by motor 1. On the shaft 52 are arranged end-to-end a sleeve 38 including a disc 39 and a sleeve 40 including an abutment flange 41. Between disc 39 (which forms the actuating element) and the abutment flange 41 are successively disposed, a friction washer 5, a first rotatable driving element formed by a sleeve 42 and a second friction washer 10. The sleeve 42, which is turnably mounted on the sleeves 38 and 40, comprises a disc 43 disposed facing a fixed element 25 and carries a toothed wheel 8. On the sleeve 38 is turnably mounted a second driving element in the form of a disc 44 whose periphery forms a pulley 30 with a groove 31. An abutment 45 prevents axial displacement of disc 44 on sleeve 38. Spring 16 axially holds the sleeves 38 and 40, and the elements they support, in abutment against stop ring 11 on the end of shaft 2. The fixed element 25 (which is a flat plate having a surface facing the disc 43) and the disc 39 each have a hollow spiral 46 and 47 respectively each cooperating with a respective ball 20 and 21 lodged partly in the spiral and partly in a respective groove 48 and 49 disposed transverse to the corresponding spiral. The grooves 49 and 49 are disposed radially, respectively in disc 43 of the first rotary driving element and in the second driving element formed by disc 44.

Operation is similar to that of the mechanism of FIG. 1. Starting from the position of FIG. 2, a rotation of shaft 52 in direction 35 immediately rotates the first driving element, i.e., sleeve 42 and its disc 43 so that groove 48 drives the ball 20 along the spiral 46 until the ball 20 comes into abutment against the end 50 of groove 48. The first driving element (42, 43) is then held stopped by the fixed element 25, the friction coupling allowing a slip. During the same time, the ball 21 is radially displaced along groove 49 by the spiral 47 of the disc 39 which also turns in direction 35. When the ball 21 comes to abut against the end 51 of groove 49, the second driving element i.e., disc 44 is in turn rotatably driven by disc 39 as long as the shaft 52 continues to rotate in direction 35. Rotation of the shaft 52 in direction 34 would produce a similar operation and the balls would reassume their position of FIG. 2.

Figure 3:
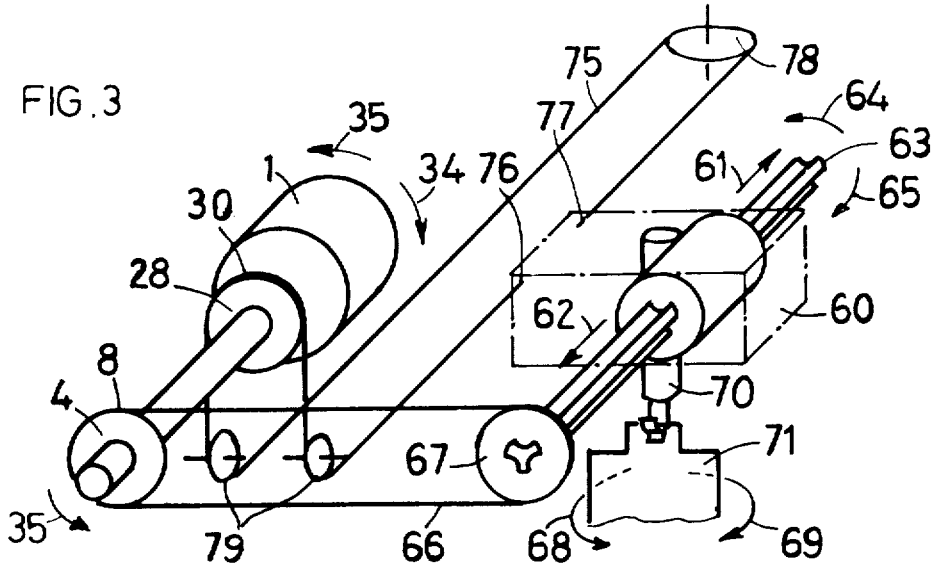
FIG. 3 is a schematic perspective view of part of a blind with vertical orientable slats incorporating a drive mechanism according to the invention.
Figure 5:
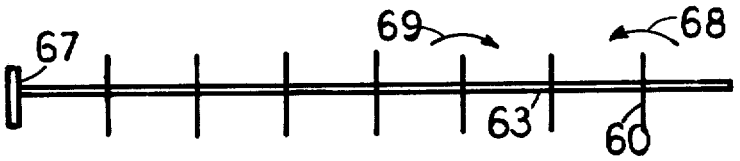
FIGS. 4 to 8 are schematic top plan views of the blind of FIG. 3 in different positions.

FIG. 3 shows an application of the drive mechanism of FIG. 1 for driving a blind with orientable vertical slats. This blind includes several slat supports movable in translation according to 61 or 62 along a spline shaft 63. A single slat support 60, the first, is shown in FIG. 3. The shaft 63 may be rotatably driven at will in direction 64 or 65 by a chain 66 meshing with a toothed wheel 67 fixed on shaft 63 and with the toothed wheel 8 of the previously described drive mechanism. Shaft 63 is thus constantly kinematically connected to the first driving element 4 which carries the toothed wheel 8. A rotation of the shaft 63 in direction 64 or 65 produces rotation, respectively in direction 68 or 69, of a part 70 of each support 60 and the slat 71 which is fixed to said part. The means kinematically coupling the rotation of the shaft 63 with orientation of the slats 71 is not shown in the drawings (FIG. 3); it may for example be formed by an endless screw and worm system.

Also, the first sliding support 60 is movable in direction 61 or 62 by a flexible belt 75 whose two ends 76 and 77 are fixed on either side of the support 60, this belt 75 passing behind a pulley 78 disposed towards one end of the shaft 63, under two pulleys 79 disposed towards the other end of shaft 63, and about the pulley 30 forming part of the previously described second driving element 28. This element 28 is thus constantly kinematically connected to the support 60, a rotation of the driving element 28 in direction 34 or 35 driving the support 60 in translation respectively in direction 61 or 62. FIG. 3 also schematically shows the motor 1; all of the other elements of the drive mechanism shown in detail in FIG. 1 are not repeated in FIG. 3.

Figure 4:
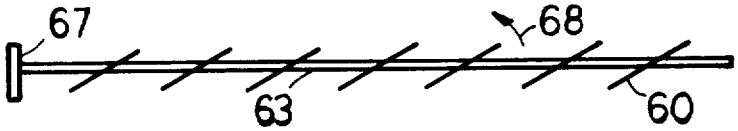

Let us suppose that to begin with the blind is entirely unfolded with its slats oriented and spaced apart from one another as shown in FIG. 4, the balls 20 and 21 of the drive mechanism occupying the position shown in FIG. 1.

When the motor 1 is started and its shaft 2 is driven in direction 35, the toothed wheels 8 and 67 as well as the spline shaft 63 immediately turn in the same direction 64. The shaft 63 turns all of the slat supports 60 and the slats in direction 68. As long as the ball 20 does not come to abut against the end 36 of groove 22, the slats continue to turn in direction 68. The ball 21 also moves towards the end 37 of groove 23 but as long as it does not arrive there, the pulley 30 remains stationary as well as the slat support 60 to which it is connected. It is thus possible to actuate the shaft 2 in rotation successively in directions 35 and 34 to orient the slats in corresponding directions 68 and 69, without the first slat support 60 moving in translation.

Figure 6:
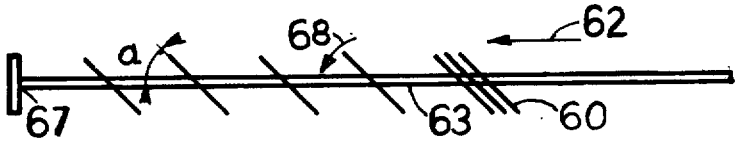
Figure 7:
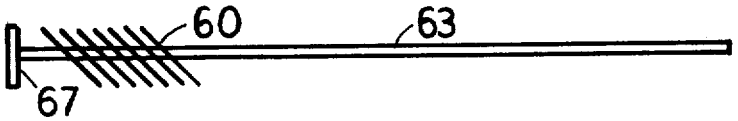

To fold away the blind, it suffices to maintain rotation of the shaft 2 in direction 35. When the ball 20 comes to abut against the end 36 of groove 22, rotation of the slats in direction 68 stops in the angular position shown in FIG. 6. This position is selected so that the slats are oriented at a given limiting angle *a*. When the ball 21 comes to abut against the end 37 of groove 23, the pulley 30 drives the first slat support 60 in direction 62 and this first support 60 successively pushes along the other supports, as shown in FIG. 6, until all of the slats are finally folded away into the position shown in FIG. 7. Rotation of the shaft 2 according to 35 is then automatically stopped, for example by a torque-limiting stop device.

Figure 8:
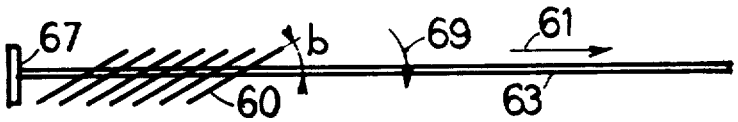

To unfold the blind, the shaft 2 is rotated in direction 34, the spline shaft 63 thus being rotatably driven in direction 65 and the slats in direction 69 until the slats make a given angle *b* in relation to the spline shaft 63, a shown in FIG. 8. This position is reached when the ball 20 arrives back in its position of FIG. 1. When the ball 21 in turn arrives in its FIG. 1 position, the pulley 30 turns in direction 34 and the support 60 moves in direction 61 (FIG. 8). The support 60 then translationally drives the other slat supports which are connected to it for example by flexible cords, not shown. The slats finally return to their initial unfolded position (FIG. 4) and rotation of the shaft 2 in direction 34 is interrupted.

Of course, the described blind could also use a driving mechanism similar to that shown in FIG. 2.

What is claimed is:

1. A drive mechanism comprising first and second rotatable driving elements kinematically connected to a common rotary actuating element respectively by a first coupling arranged to immediately couple the first driving element for a limited rotation with the actuating element when the latter is rotated and a second coupling arranged to couple the second driving element for rotation with the actuating element after a given rotation of the latter, wherein each of said couplings comprises a ramp and a facing groove transverse to the ramp, each ramp and facing groove housing a mobile piece, the ramp and groove of the first coupling being provided on the first driving element and a facing fixed surface, and the ramp and groove of the second coupling element being provided on the second driving element and the actuating element.

2. A drive mechanism according to claim 1, in which at least one of the ramps is formed by a hollow helix in a cylindrical surface, and the corresponding groove is disposed longitudinally of said cylindrical surface.

3. A drive mechanism according to claim 1, in which at least one of the ramps is formed by a hollow spiral in a generally flat surface, and the corresponding groove is disposed generally radially of said spiral.

4. A drive mechanism according to claim 1, in which the first driving element and the actuating element are mounted end-to-end on a shaft on either side of a friction element, the first rotary driving element being axially fixed and rotatable on the shaft, the actuating element being slidable along and keyed for rotation with the shaft, and comprising elastic means constantly pushing the actuating element against the friction element and the first driving element.

5. A drive mechanism according to claim 1, in combination with a blind with vertical orientable slats, of the type including a plurality of slat supports movable in translation and a shaft the rotation of which in either direction angularly sets at least a part of each support and a corresponding slat which is fixed to said part, said shaft being constantly kinematically coupled with said first driving element and said second driving element being constantly kinematically coupled to at least one of said slat supports to move it in translation.

* * * * *